US008926260B2

(12) United States Patent
Parslow, II et al.

(10) Patent No.: US 8,926,260 B2
(45) Date of Patent: Jan. 6, 2015

(54) AGRICULTURAL STORAGE CONTAINER MANIPULATOR

(75) Inventors: Harold W. Parslow, II, Washington, MI (US); Terry Pelc, Rochester Hills, MI (US)

(73) Assignee: Green-Age Products and Services, LLC, Washington, MI (US)

( * ) Notice: Subject to any disclaimer, the term of this patent is extended or adjusted under 35 U.S.C. 154(b) by 102 days.

(21) Appl. No.: 13/554,185

(22) Filed: Jul. 20, 2012

(65) Prior Publication Data

US 2013/0022437 A1 Jan. 24, 2013

Related U.S. Application Data

(60) Provisional application No. 61/509,722, filed on Jul. 20, 2011.

(51) Int. Cl.

| | |
|---|---|
| ***B65G 47/90*** | (2006.01) |
| ***B65H 15/02*** | (2006.01) |
| ***B65B 25/02*** | (2006.01) |
| ***B65B 25/04*** | (2006.01) |

(52) U.S. Cl.

CPC ..... *B65B 25/02* (2013.01); *B65B 25/046* (2013.01)

USPC ..... 414/816; 414/419; 414/764; 414/766; 414/771

(58) Field of Classification Search

CPC ..... B65G 47/248; B65G 3/04; B65G 47/24; B65G 47/244; B65G 65/23; B65H 15/00; B65H 2301/33216; B66F 9/18; B66F 9/04; B66F 9/183; B66F 9/125

USPC ..... 414/754, 757, 764, 765, 766, 767, 771, 414/782, 783, 816, 403, 419, 420, 422

See application file for complete search history.

(56) References Cited

U.S. PATENT DOCUMENTS

| | | | | |
|---|---|---|---|---|
| 2,468,326 | A * | 4/1949 | Gleason | 414/641 |
| 2,889,912 | A * | 6/1959 | Franklin et al. | 198/379 |
| 3,291,329 | A * | 12/1966 | Ord | 414/420 |
| 3,656,634 | A * | 4/1972 | Pearne et al. | 414/788.5 |
| 3,703,242 | A * | 11/1972 | Marradi | 414/414 |
| 4,187,095 | A * | 2/1980 | Frank | 65/104 |
| 4,221,517 | A * | 9/1980 | Guzzetta et al. | 414/788.6 |
| 4,470,744 | A * | 9/1984 | Steimel et al. | 414/420 |
| 5,833,428 | A * | 11/1998 | Szinte | 414/408 |
| 5,888,043 | A * | 3/1999 | Jatcko | 414/459 |
| 6,120,231 | A * | 9/2000 | Christ et al. | 414/422 |
| 6,139,243 | A * | 10/2000 | Jackson et al. | 414/405 |
| 6,224,315 | B1 * | 5/2001 | Van Arkel et al. | 414/403 |
| 6,524,058 | B1 * | 2/2003 | Watters | 414/795.7 |
| 6,722,841 | B2 * | 4/2004 | Haas | 414/422 |
| 6,962,271 | B2 * | 11/2005 | Gregson, Jr. | 222/166 |
| 2005/0060932 | A1 * | 3/2005 | Ramp | 47/67 |
| 2008/0025831 | A1 * | 1/2008 | Ikehata | 414/781 |

* cited by examiner

*Primary Examiner* — Saul Rodiguez
*Assistant Examiner* — Lynn Schwenning
(74) *Attorney, Agent, or Firm* — Young Basile Hanlon & MacFarlane P.C.

(57) ABSTRACT

An automated, high volume container manipulator and process useful with an agricultural seed box. In an exemplary application, the manipulator removes an upper ring of a seed box, rotates the ring 180 degrees and places the ring over the lower seed box base in a nested condition. Container lid removal, transport and replacement devices and processes are also included.

18 Claims, 15 Drawing Sheets

AGRICULTURAL STORAGE CONTAINER MANIPULATOR

CROSS-REFERENCE TO RELATED APPLICATIONS

This application claims priority benefit to U.S. provisional patent application No. 61/509,722 filed Jul. 20, 2011, the entire contents of which is incorporated by reference.

TECHNICAL FIELD

The present invention is generally in the field of storage and transfer equipment.

BACKGROUND

In agriculture, and particularly in the agricultural seed industry, high volume planting seed is generated by large seed manufacturers. The seed is loaded into seed boxes which typically include a base and a removable upper ring portion which sits on and engages the base thereby practically doubling the height and volumetric capacity of the box. Typical seed boxes store approximately 50 acres of seed and weigh a total of about 300 pounds, the upper ring weighing about 175 pounds.

Typical seed box upper rings are designed so they can be removed from the base, turned over 180 degrees so the internal cavity faces the base, and lowed down over the top of the base to nest thereby reducing the height of the boxes for compact storage and transportation.

When the seed box is to be filled, prior processes required two or more individuals to manually assemble the nested seed box. This required manually lifting and rotating the inverted ring and installing it on back on the base. On high volume seed manufacture, hundreds and hundreds of seed boxes are cycled every day and several thousand are typically in process at the manufacturing facility, in transport to buyers and farms, and/or in transport to be returned to the seed manufacturing for cleaning, refilling and/or temporary storage.

The present invention improves on prior equipment and processes which required burdensome operations which are slow, imprecise and required numerous human operators. Prior devices were often specific to a specific storage container and could not easily accommodate other containers. Prior devices were also not suitable for the high volume demands of modern manufacturing facilities.

BRIEF SUMMARY

The present storage container manipulator has many uses, but is particularly useful in the automated manipulation, assembly and disassembly into nested storage position of agricultural seed boxes.

In one example, the present invention includes a modular, self-contained frame structure having lifting and manipulator mechanisms. The lifting mechanism selectively raises and lowers the manipulator to accommodate and receive different sized storage containers. The manipulator mechanism operates to grip the upper seed box ring, rotate the ring 180 degrees to either assemble or disassemble the seed box.

A conveyor is connected to the frame to quickly move seed boxes into and out of the frame structure for processing.

In another example, a container lid removal device is used for removing the lids from seed boxes, reorienting the upper box ring, lowering the ring over the base in a nested state and placing the lid back on the box for further processing.

In another example, a lid removal and transport system is used. In the example, lids are individually removed and transferred through a second and third lid station positioned in a bridge section and second tower frame. The lids are then reinstalled on the reoriented containers that have been moved out of the first tower frame and passed through an inspection or other process.

In an exemplary process, a container oriented in a first state, for example an assembled seed box, is positioned in the manipulation device. Lift and manipulation devices are positioned to engage and alter the state of the container from the first state to, for example, a second state where the container is reoriented to a nested position for compact storage and transportation. The process is reversed to assemble the seed boxes for use.

In one example, the manipulator includes a device and process to remove the lid from a container box, hold the lid above the container while the ring is manipulated to either an assembled or nested storage position and then lower the lid and connect it to the bottom of the ring structure for secure storage and transport of the seed box. The process is repeated to install the lid on an assembled seed box ready to be filled. In an alternate lid removal process, the lids are transferred through a second and third lid station to a second tower frame and reinstalled after the containers have gone through additional processes, for example an inspection process.

BRIEF DESCRIPTION OF THE DRAWINGS

The description herein makes reference to the accompanying drawings wherein like reference numerals refer to like parts throughout the several views, and wherein.

DETAILED DESCRIPTION OF EMBODIMENTS

In FIGS. 1-15, examples of devices and methods for use in manipulating large storage containers are illustrated and explained further below. In a preferred but exemplary application, the device and methods are useful in assembling and disassembling two-piece agricultural seed boxes as further described below.

Figure 1:
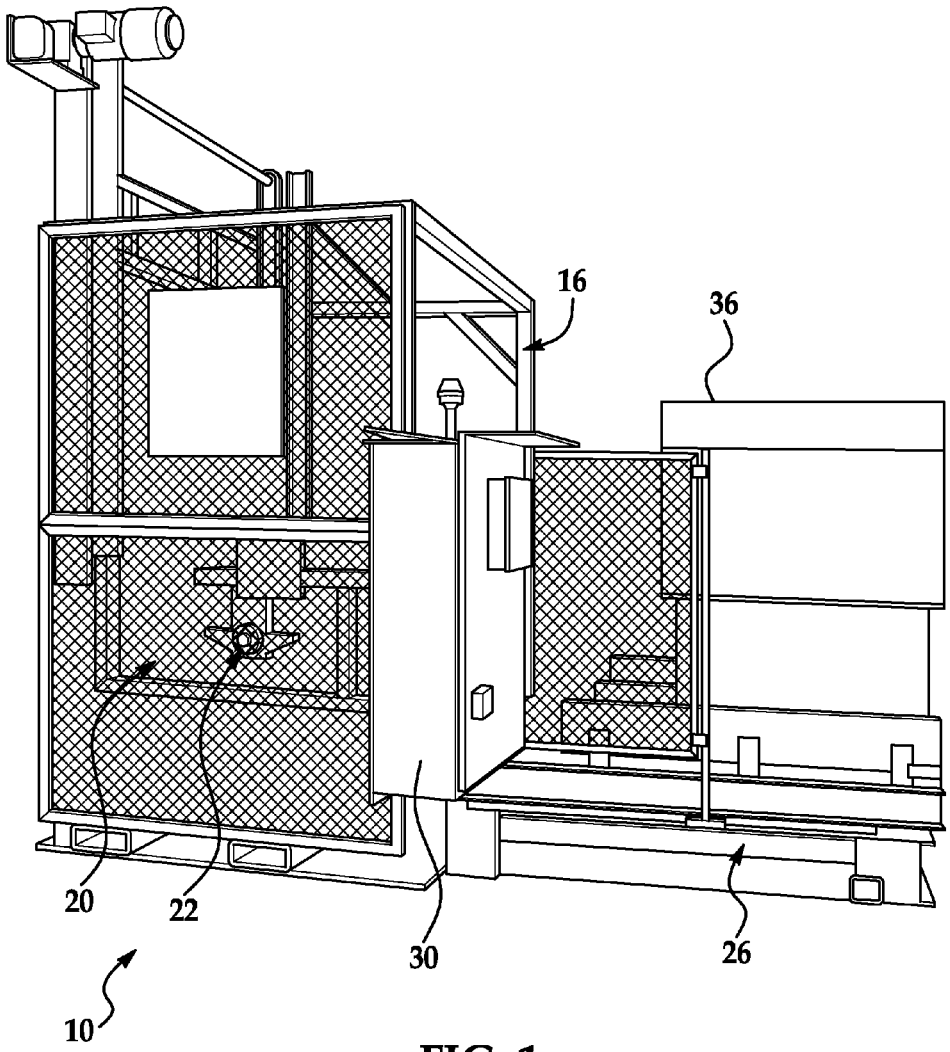
FIG. 1 is a left side view of one example of the storage container manipulator in use with an exemplary agricultural seed box.
Figure 2:
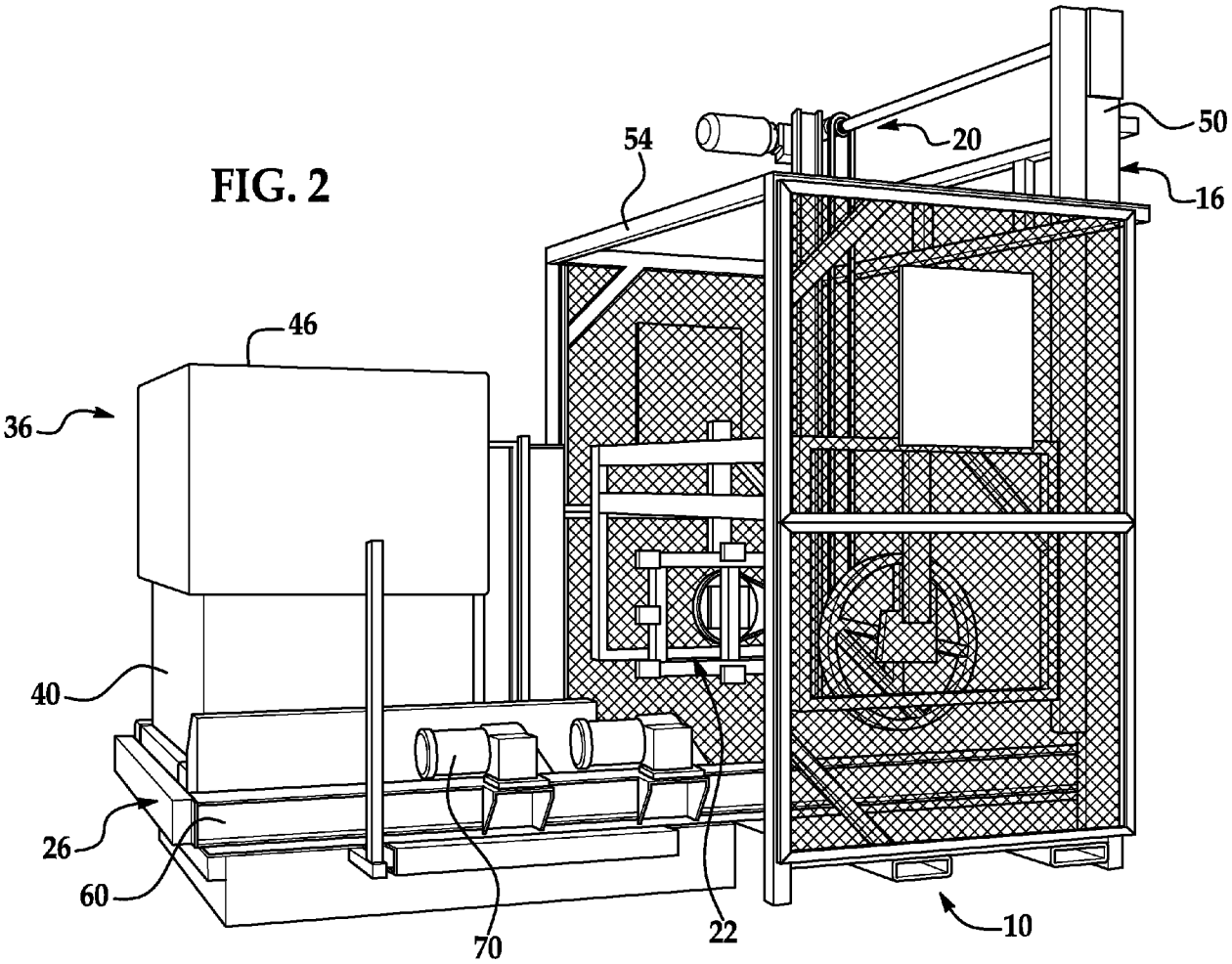
FIG. 2 is a right side view of the manipulator shown in FIG. 1.
Figure 3:
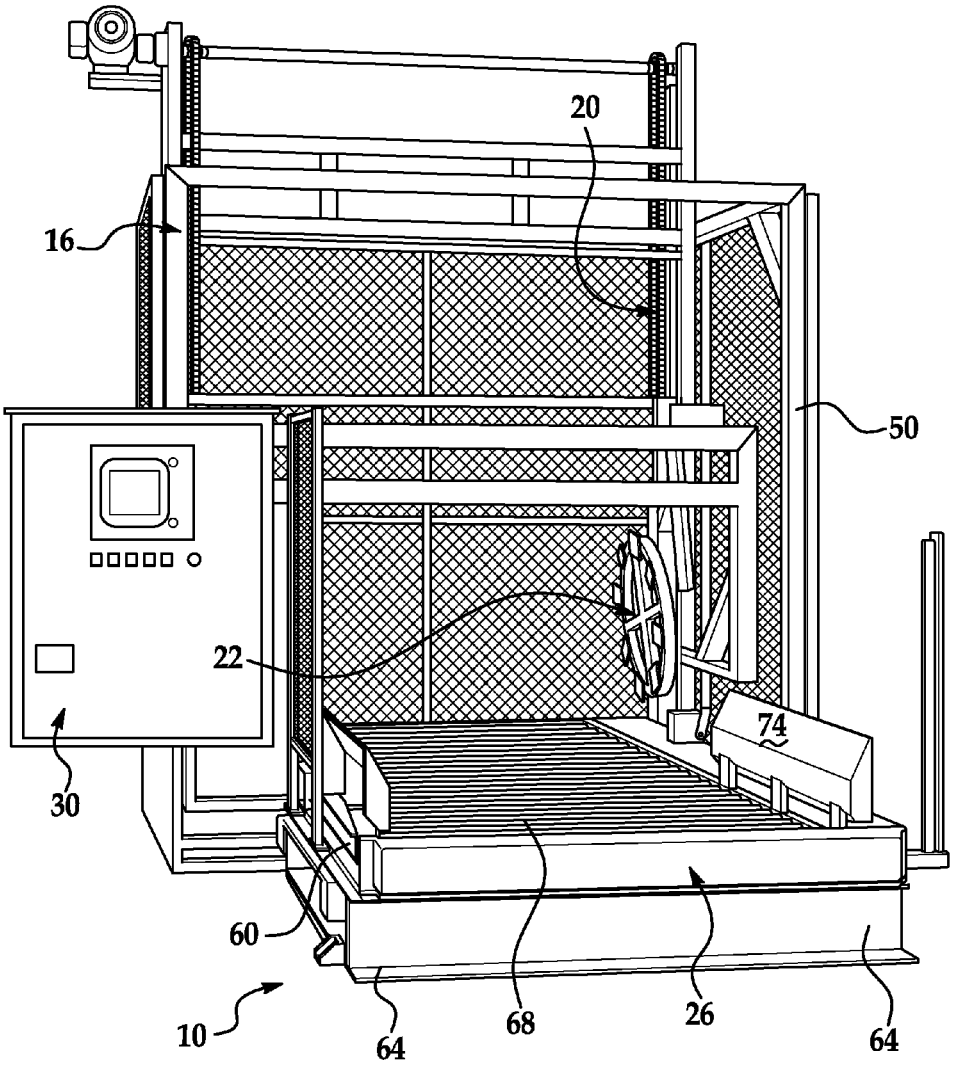
FIG. 3 is a front elevational view of the manipulator in FIG. 1 (shown without the seed box)

Referring to FIGS. 1-3, an example of a storage container manipulator 10 is shown. In the example, manipulator 10 includes a heavy-duty, rigid first tower frame structure 16, a lift mechanism 20 supported by the frame 16, a container manipulator device 22 connected to the lift mechanism 20, a conveyor 26 in communication with the frame 16 and a control panel 30 to set and maintain operations of the manipulator 10. The preferred device and method is useful on an agricultural seed box having a base 40 and a removable upper ring 46 which, as shown in an assembled position atop the base, provides a large interior cavity for the secure storage and transportation of seed. In examples used throughout this description, a seed box 36 in an assembled position having the upper ring installed on top of the base 40 for receipt and storage of seed or other media, is referred to as a first state or orientation of container 36. The alternate or second state of box 36 is defined as the compact or nested orientation or condition where the upper ring 46 is inverted and placed above and around the base 40. Other containers, useful for storing and transporting other materials known by those skilled in the art may be used.

In the example, first tower frame 16 includes four vertical pillars 50 connected by several cross-members 54 which define a generally rectangular space for movement and manipulation of the seed box 36 as further described below. Other structural members, orientations and configurations of the pillars 50 and cross-members 54 suitable for the application may be used.

Figure 4:
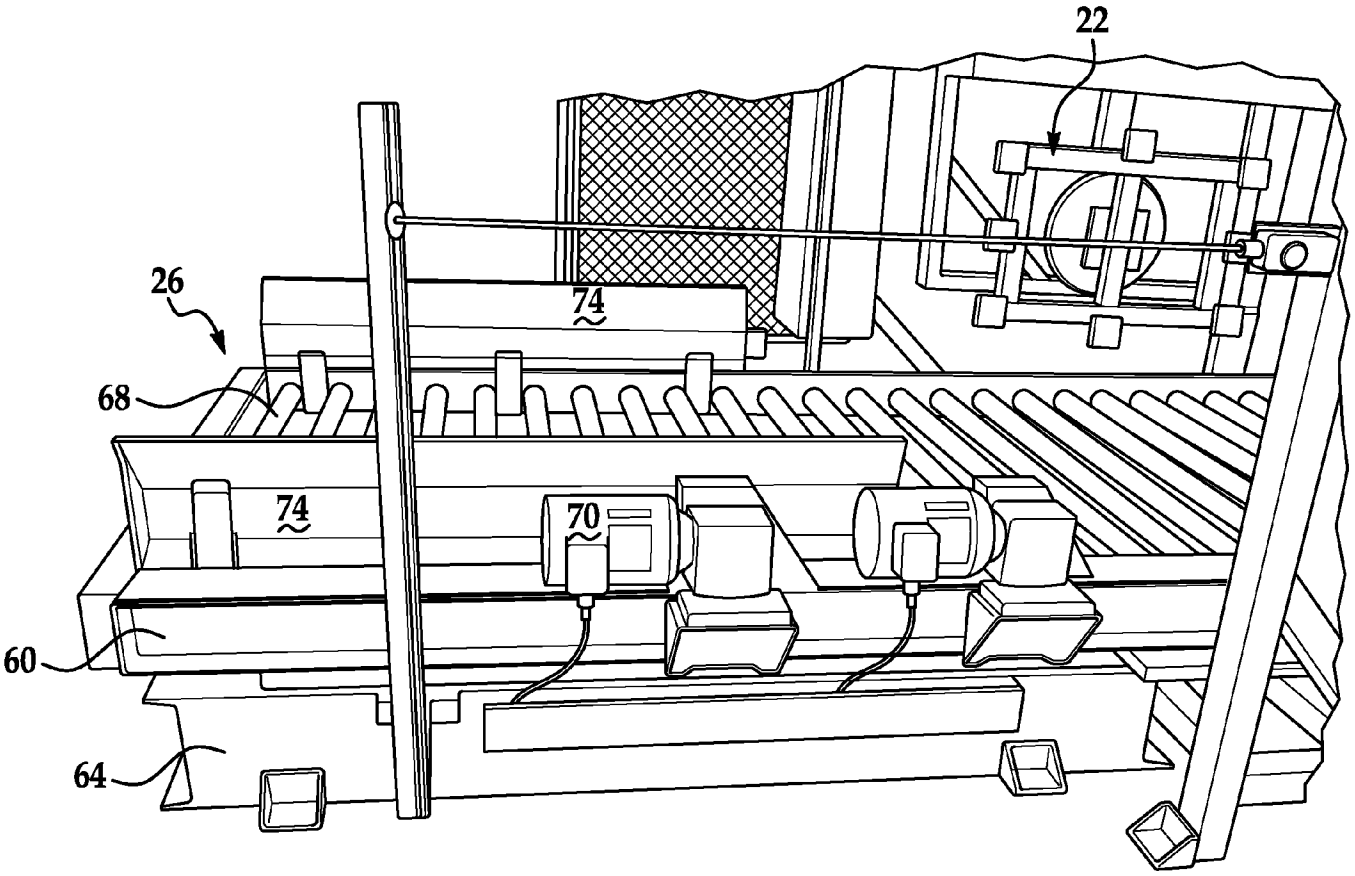
FIG. 4 is an enlarged partial right side view of the manipulator in FIG. 2.

In the example illustrated, a conveyor 26 is used on one side of the tower frame 16 leading into the processing space for movement of seed boxes 36 into and out of the frame for manipulation and/or other processing. As best seen in FIGS. 3 and 4, the exemplary conveyor, includes horizontal, parallel rails 60 which are supported by a base 64 positioned on a concrete slab or other firm support surface. A plurality of rollers 68 are journaled to the rails through bearings allowing free rotation of the rollers about respective rotational axis. Guide panels 74 may be positioned on opposing sides of the rollers 68 to assist in the proper initial placement and orientation of the seed box 36 on the conveyor 26.

In a preferred example, conveyor 26 includes at least several rollers 68 that are engaged with a powered drive mechanism 70 which selectively and forcibly rotates at least several rollers to forcibly move the seed box 36 positioned on the conveyor in a direction toward or away from the frame 16 as best seen in FIGS. 1 and 2. The rollers can be powered by a motor in communication with a controller that is preprogrammed with instructions and operations suitable for the particular application. Although conveyor 26 is shown extending from one side of tower frame 16, it is understood that a second conveyor (not shown) can extend from the opposing side of tower frame 16 so a continuous conveyor path through tower frame 16 is used.

Figure 5:
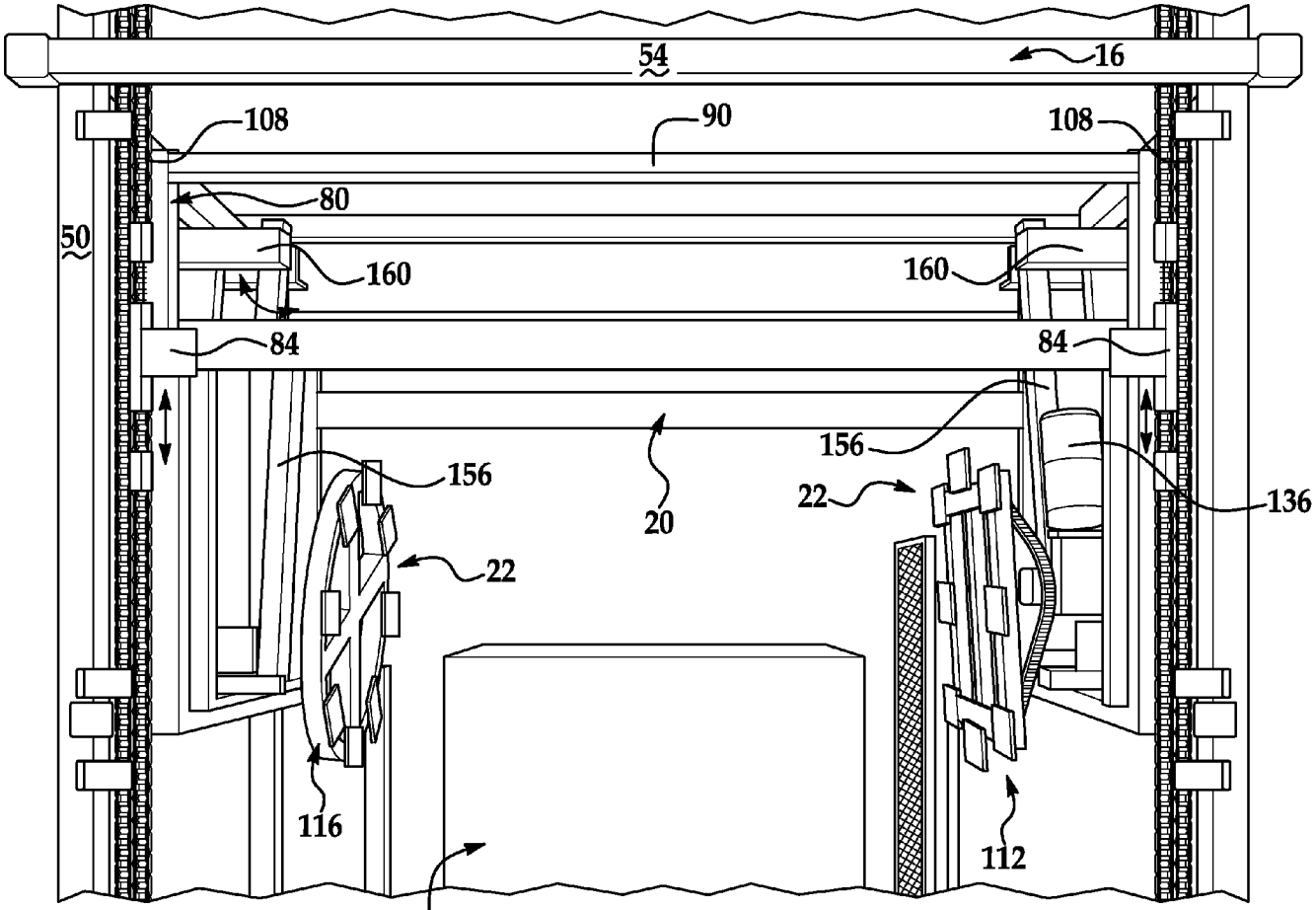
FIG. 5 is an partial rear elevational view of the manipulator shown in FIG. 1.
Figure 6:
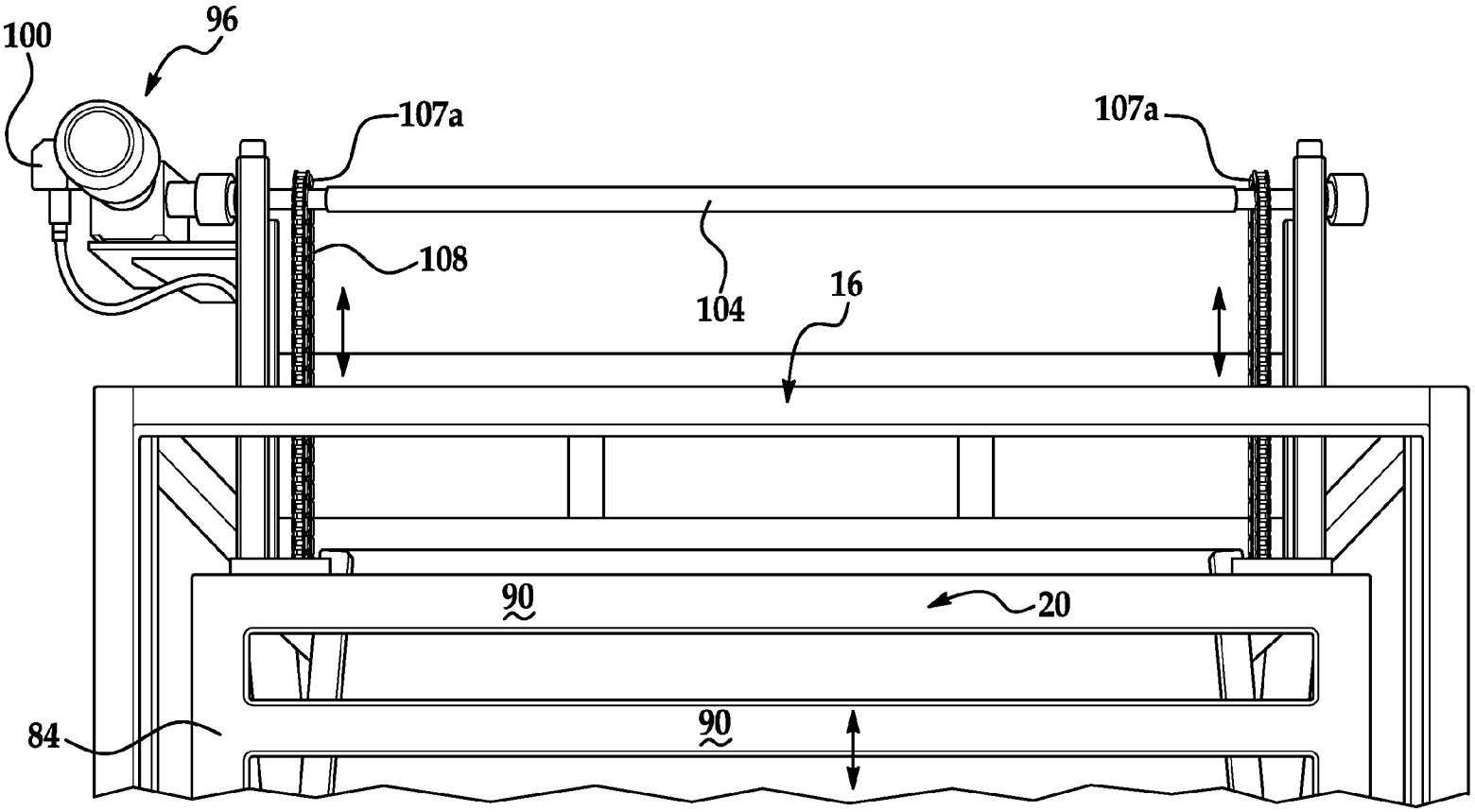
FIG. 6 is a partial front elevational view of the manipulator shown in FIG. 3.

Referring to FIGS. 2, 5 and 6, an exemplary lift mechanism 20 is illustrated. In the preferred example shown, lift mechanism 20 is useful in selectively raising and lowering the manipulator mechanism 22 relative to tower frame 16 to accurately and precisely position the manipulator grippers relative to the seed box 36 as further described below.

Exemplary lift mechanism 20 includes a lift frame 80 which includes vertical support structures 84 and cross-members 90 forming a generally rectangular frame structure having a processing space between the supports and members. In the example, at least two of the vertical support members are engaged with the vertical pillars 50 allowing the lift frame 80 to move vertically relative to pillars 50 and frame 16. Guide tracks, rollers and other mechanical devices and structures (not shown) connecting the frame 80 to the tower frame 16 allowing for such controlled, accurate, precise and relative vertical movement known by those skilled in the art may be used.

Figure 7:
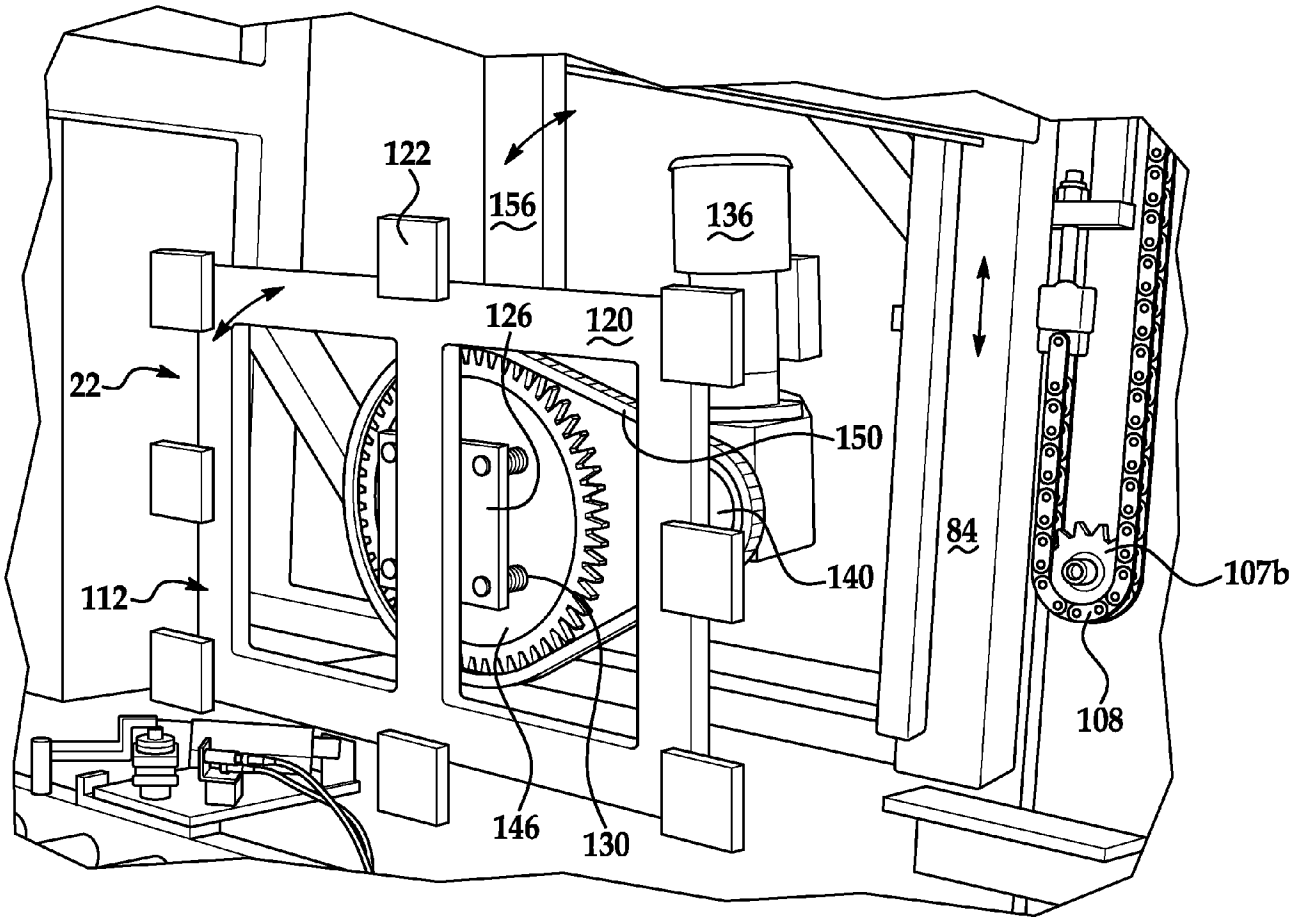
FIG. 7 is a partial perspective view of a portion of the manipulator mechanism of the manipulator shown in FIGS. 1 and 2.

Lift mechanism 20 further includes a lift drive 96 having a drive motor 100 connected to frame 16 as generally shown. A drive shaft 104 is connected to the motor 100 and extends across frame 16 to span the lift frame 80 as best seen in FIG. 6. Dual belts, for example chains 108, engage sprockets 107*a* on the drive shaft 104, sprockets 107*b* on the frame 16 (as best seen in FIG. 7) and are fixedly connected to the lift frame 80 as best seen in FIGS. 5 and 7, to selectively move the lift frame 80 relative to frame 16. Alternate lift drive devices and drives 96 other than electric motors and chains known by those skilled in the art may be used.

Referring to FIGS. 5 and 7-10, a preferred example of container manipulator mechanism 22 is illustrated. In the example, manipulator mechanism includes a first gripper 112 and an opposing second gripper 116 connected to the lift frame 80 for use in selectively engaging the sides of seed box 36 upper ring portion 46. Each gripper 112 and 116 includes a frame structure 120 and a plurality of pads 122 connected to the frame and extending into the processing space defined by frame 16 and lift frame 80. In the example shown, first gripper 112 is a drive gripper connected to a drive mechanism described below, and second gripper 116 is a slave gripper which is not powered. It is understood that second gripper 116 could alternatively serve as the drive gripper or both grippers could be synchronously driven to suit the particular application and performance specifications.

In the example illustrated, both grippers' frames 120 are rotatably connected to the lift frame 80 allowing for relative and independent rotational movement of the respective gripper 112 and 116 to the lift frame 80 and frame 16. In the examples, each gripper frame 120 includes a mounting plate 126 with compression coil springs 130 allowing a predetermined amount of transverse movement of the gripper frames 120 relative to the lift frame 80 to provide tolerance for a secure grip of the grippers to the seed box 36 as further explained below.

Figure 8:
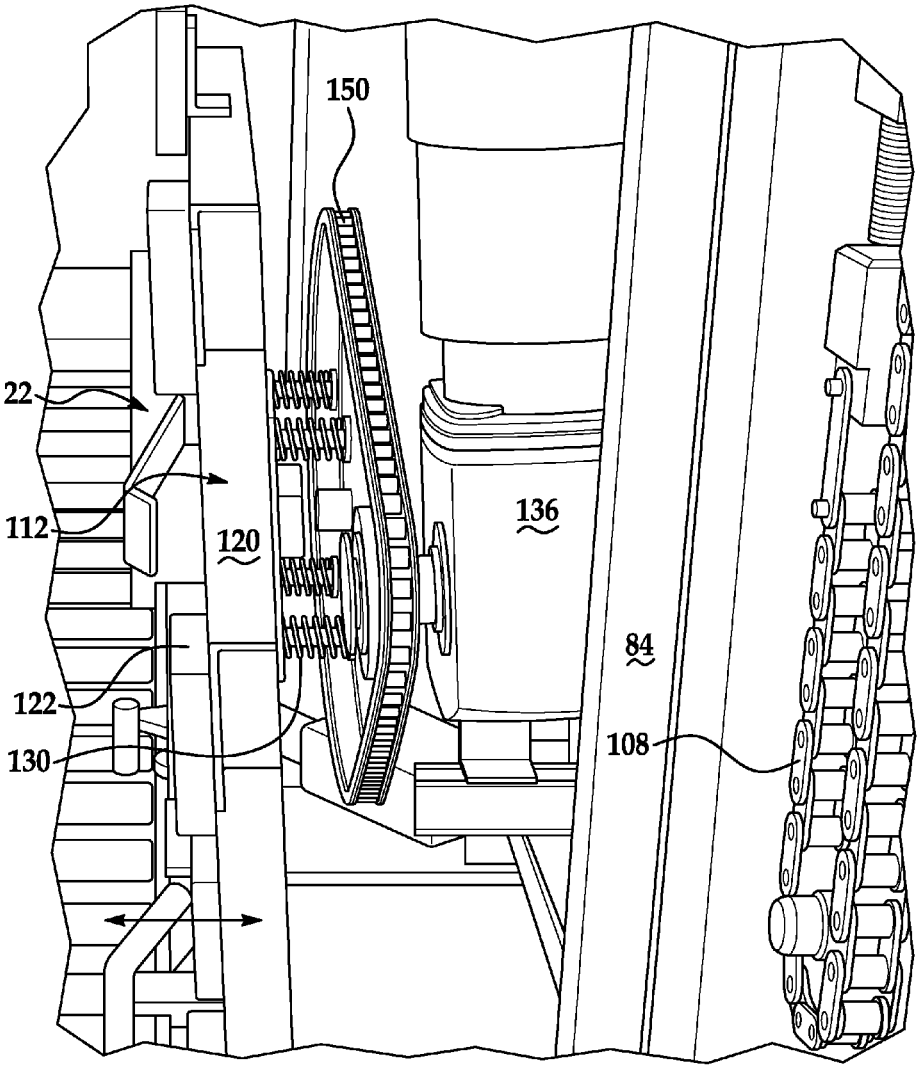
FIG. 8 is a rear elevational view of a portion of the manipulator mechanism shown in FIG. 7.

Referring to FIGS. 5, 7 and 8, further details of first gripper 116 used as the driven gripper are illustrated. In the example, a gripper drive motor 136 is connected to lift frame 80 and moves vertically along with lift frame 80 relative to frame 16 as described above. Drive motor 136 includes an output shaft and a sprocket 140 which is connected by a chain 150 to a drive pulley 146 connected to the gripper 112 frame 120. On selective activation and rotation of motor 136, pulley 146 rotates causing rotation of driven first gripper 112 via shaft 124 to forcibly rotate gripper 112 relative to lift frame 80 and frame 16.

Figure 9:
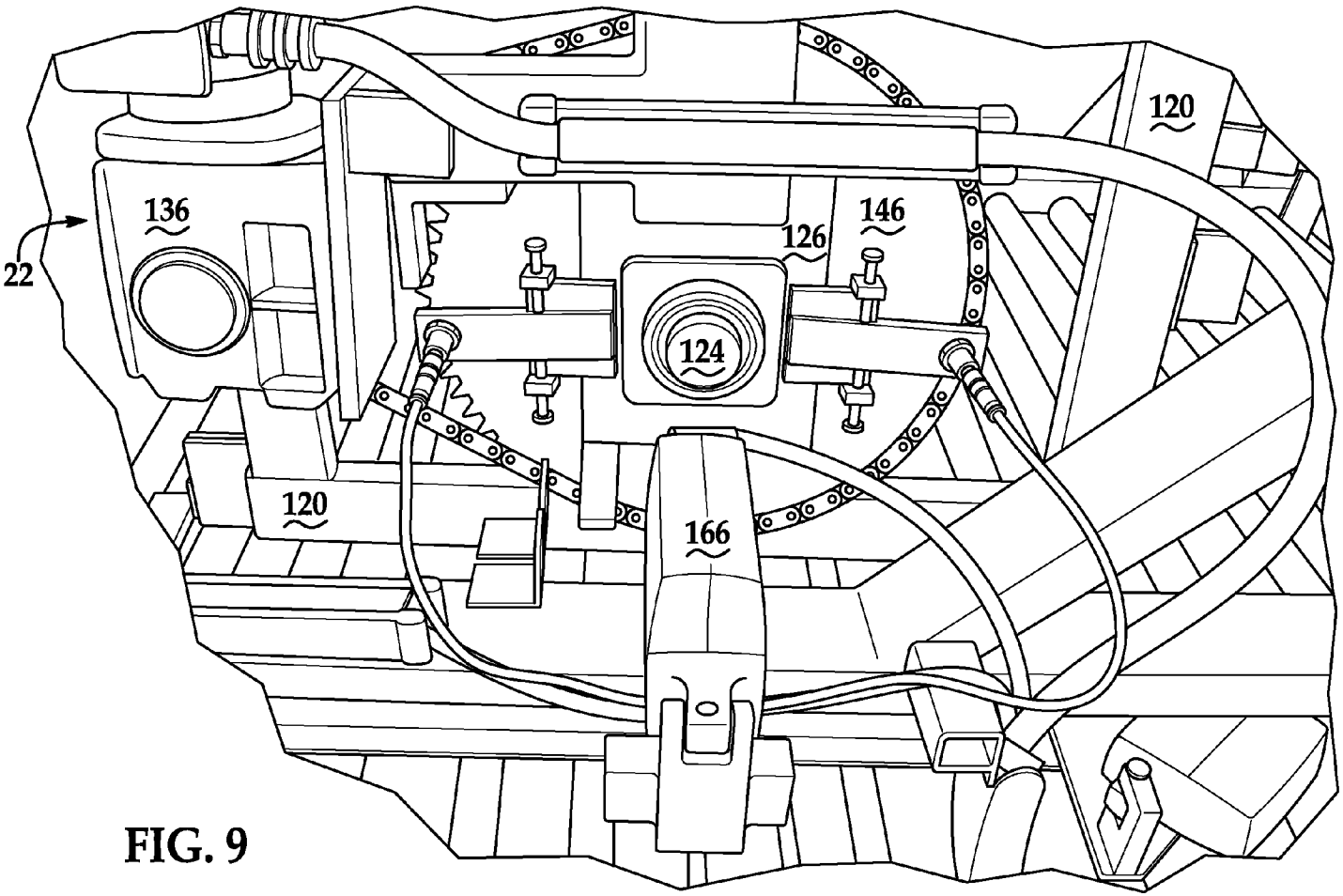
FIG. 9 is a partial side view of the manipulator mechanism shown in FIG. 7.
Figure 10:
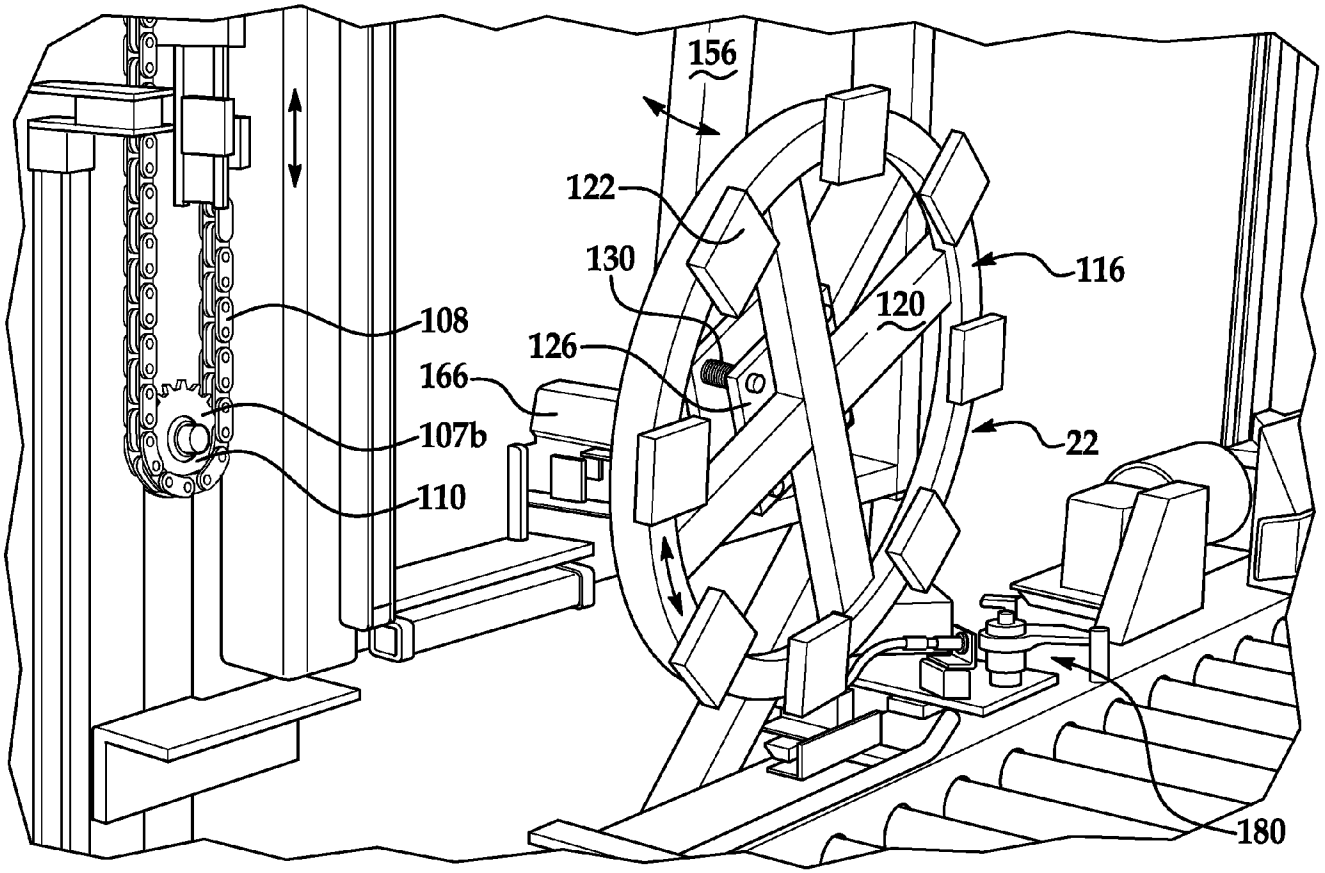
FIG. 10 is a partial perspective view of a portion of the manipulator mechanism of the manipulator shown in FIGS. 1 and 2.

As best seen in FIGS. 5 and 7, exemplary manipulator mechanism 22 further includes a pair of pivot arms 156 pivotally mounted to an upper portion of lift frame 80 and suspending each relative gripper 112 and 116 below as best seen in FIG. 5. As best seen in FIGS. 9 and 10, a pneumatically powered cylinder and piston 166 is transversely connected to a lower portion of the lift frame 80 and selectively pivotally moves the respective grippers 112 and 116 toward one another about respective pivot points 160 to selectively engage and grip the adjacent sides of seed box upper ring 46 to manipulate the upper ring 46 relative to the box base 40 as further described below. Each piston 166 is in communication with a controller to synchronously move the grippers toward one another based on a predetermined program stored in a processor (not shown). Other devices, structures and methods for transversely moving the grippers 112 and 116 to grip the seed box 36 known by those skilled in the art may be used.

Figure 11:
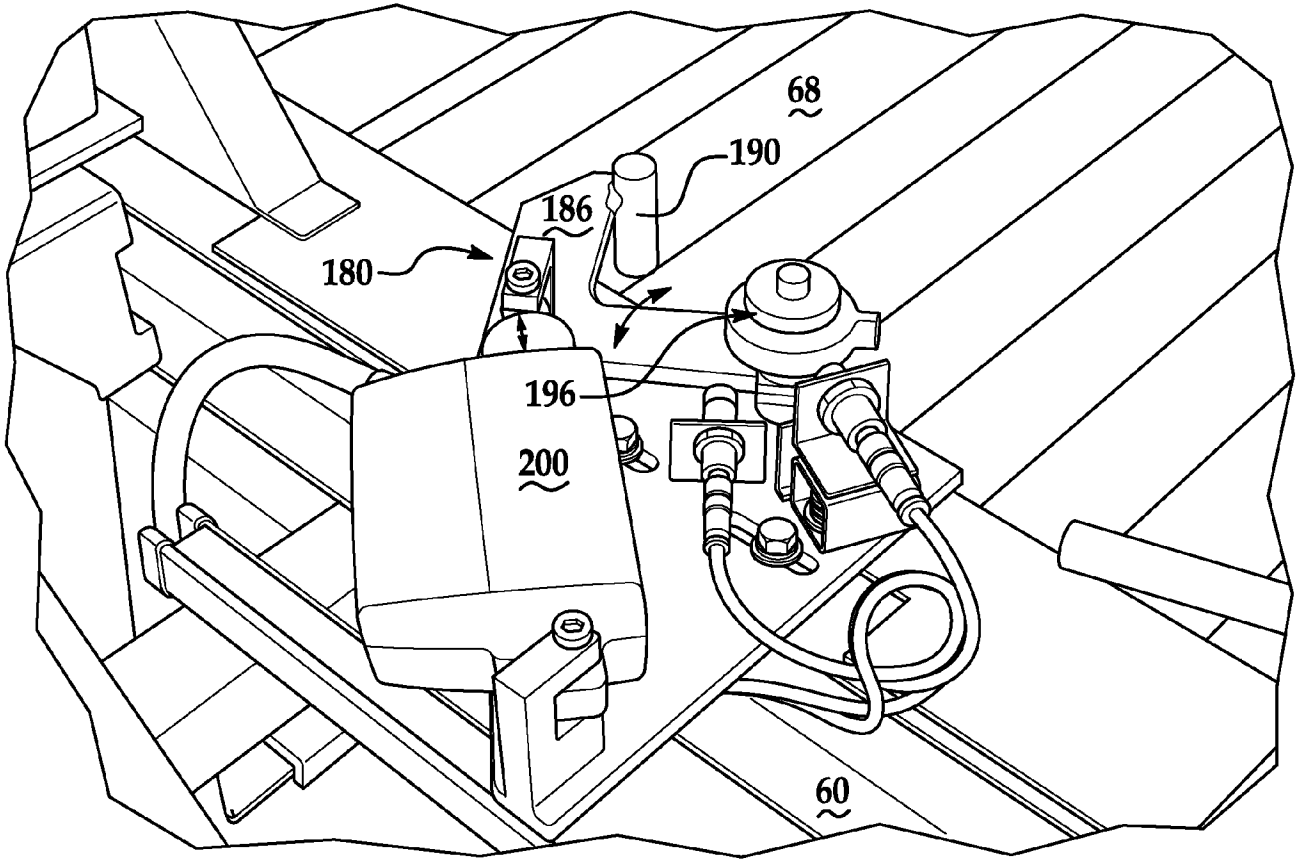
FIG. 11 is a perspective view of an example of a container locator device shown in the manipulator shown in FIGS. 1 and 2.

Referring to FIGS. 10 and 11, in a preferred example manipulator 10, at least two container locators 180 are included and used to positively locate the container 36 in the processing space so the container base 40 is accurately and precisely positioned relative to the frame 16 and the grippers 112 and 116 prior to manipulating the box ring 46.

As illustrated, each exemplary locator 180 includes a locating arm 186 including a contact pad 190 on a distal end of the arm which is pivotally connected at a pivot point 196 to a respective rail 60 as generally shown. A pneumatic cylinder and piston 200 mounted to the rail 60 selectively rotates arm 186 about pivot 196 to engage contact pad 186 with an adjacently position side or corner portion of box base 40. Cylinders 166 are in communication with a controller and are preferably synchronized to move and engage the box base 40 according to a predetermined program to suit the particular application. In a preferred example, four box locators are used and are positioned at different corners of box base 40 to positively locate the seed box 36 in the X and Y directions relative to frame 16. Locators 180 precisely and accurately position box 36 relative to frame 16, lift frame 80 and grippers 112 and 116.

Figure 12:
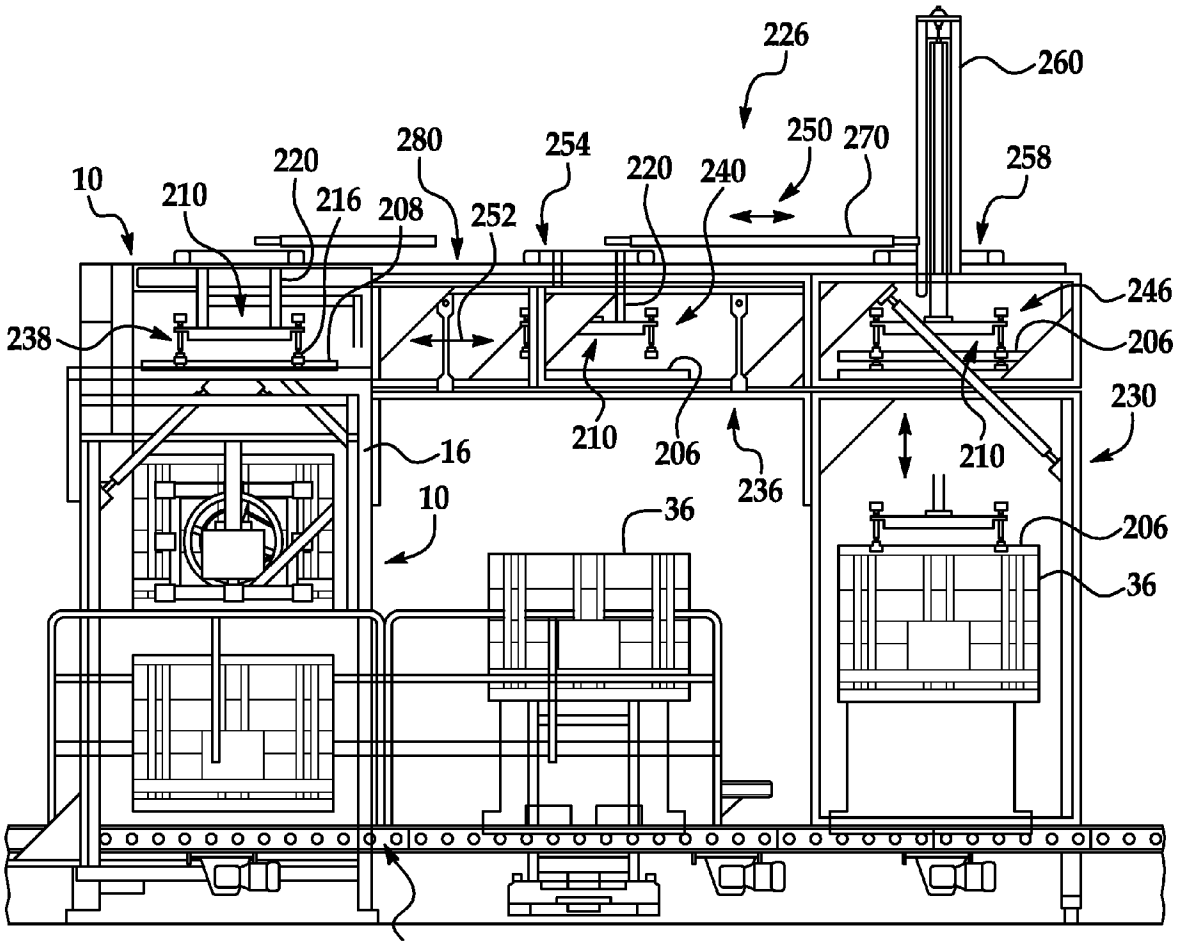
FIG. 12 is a side elevational view of an example of the container manipulator of FIG. 1 in use with a lid removal and transfer device.

Referring to FIG. 12, in a preferred use of the container manipulator for agricultural seed boxes, the boxes often include a removable lid 206 to keep moisture and other debris from entering the box. In order to nest the upper ring 46 over the base 40, the lid needs to be removed. In some seed box designs, these lids are friction fit over the upper ring or include toggle or lever devices to lock the lids on.

In an example not shown, manipulator 10 may further include a device (not shown) and method for dislodging a removable lid 206 covering seed box 36. In one example, two or more actuators, preferably four, one for each corner of the lid, are connected to the first tower frame 16 and are selectively cycled to extend into the processing area and engage the lid with sufficient force and/or movement to dislodge the secured lid from the upper ring 46. In a preferred device and method of operation, the actuators are controlled by controller 30 and are sequentially activated one at a time, although other methods known by those skilled in the art may be used. In one example, the actuators are pneumatic cylinders with pistons having an end effector or device suitable to grasp or dislodge the lid or, for example, a lever or fastener that is used to secure the lid to the box.

As best seen in FIG. 12, a lid removal device 210 is connected to an upper portion of the first tower frame 16 with actuators, preferably a plurality of pneumatically operated suction cups 216, extend from a support 220 connected to first tower frame 16 as generally shown. In operation, when, for example, a seed box 36 is in a first state with the upper ring 46 sitting atop the base 40 at the box full height, and is to be reoriented into a second state in a nested position, the lid 206 needs to be removed so the upper ring 46 can be rotated 180 degrees and be placed over the base for a compact, nested orientation. In this example, manipulator device 22 would grasp the upper ring 46 with the grippers as described above and through the lift device 20 raise the upper ring 46 and attached lid 206 along the second path of travel until the lid 206 is placed in engaging contact with the suction cups 216. The controller 30 would activate the pneumatic suction cups to evacuate the air so that cups 216 firmly grasp the lid. The lift 20 would then lower the manipulator device and engaged upper ring 46 to a lower height where it can be rotated 180 degrees thereby orienting the upper ring 46 for placement or nesting over the base 40 as described above.

In the example, the lift device 20 would then again raise the reoriented upper ring 46 to again place the upper ring in contact with the suspended and stationary lid 206. In one example, the lid 206 positively engages a portion of the inverted upper ring 46. On satisfaction of safety checks, the suction cups are deactivated releasing lid 206. The lift 20 is then lowered placing the upper ring 46 over the base 40 in a second, nested container state.

Where a seed box container 36 is being assembled, the first state is the compact/nested state and the second state is the assembled/full-height container with the upper ring 46 atop the base 40. The lid 206 would first be removed from the upper ring and then installed atop the ring 46 through use of the lid removal device 210 in a similar manner as described. Other methods and devices known by those skilled in the art to install and remove lids 206 may be used.

Figure 13:
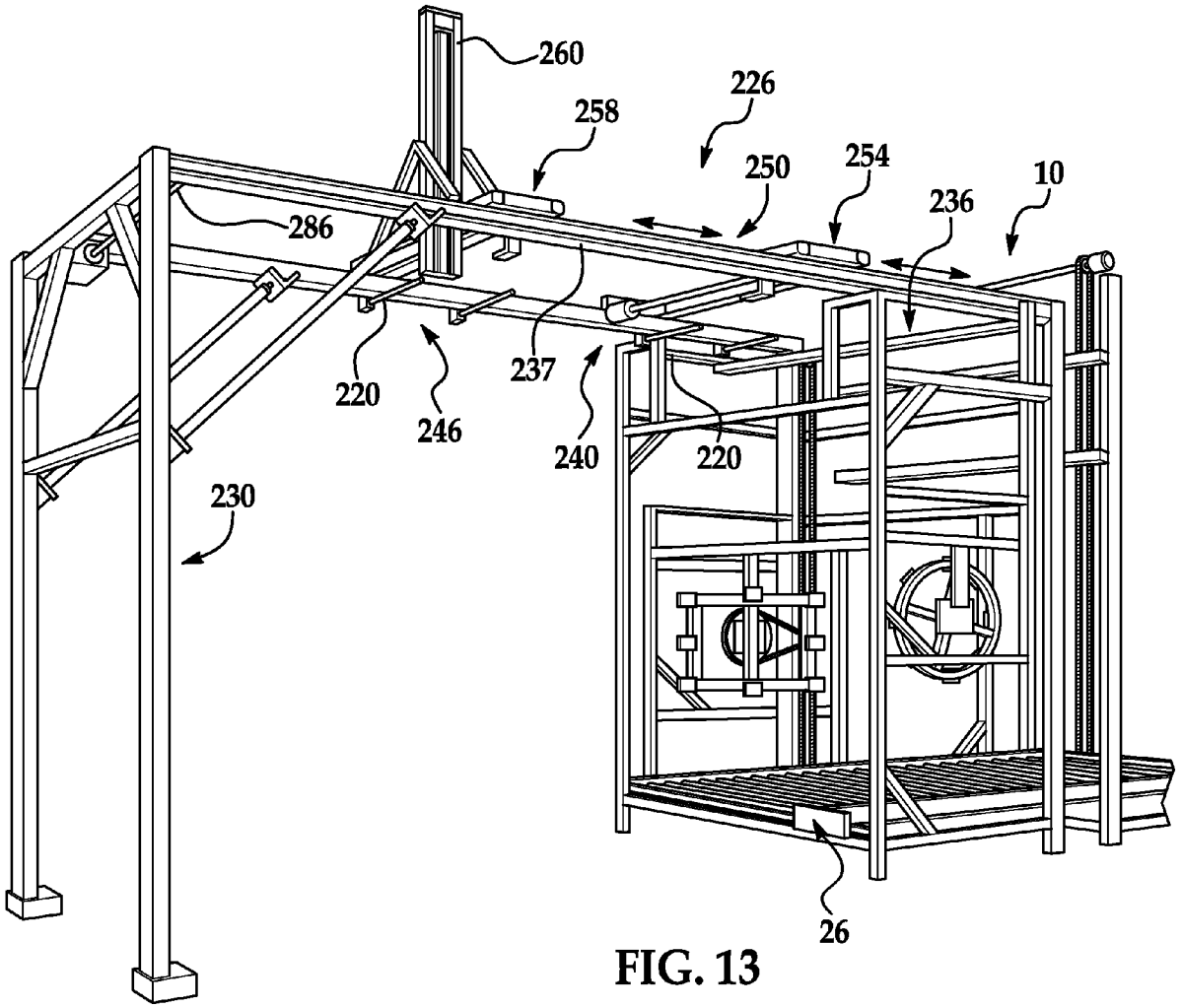
FIG. 13 is a perspective view of an alternate example of the device shown in FIG. 12.
Figure 14:
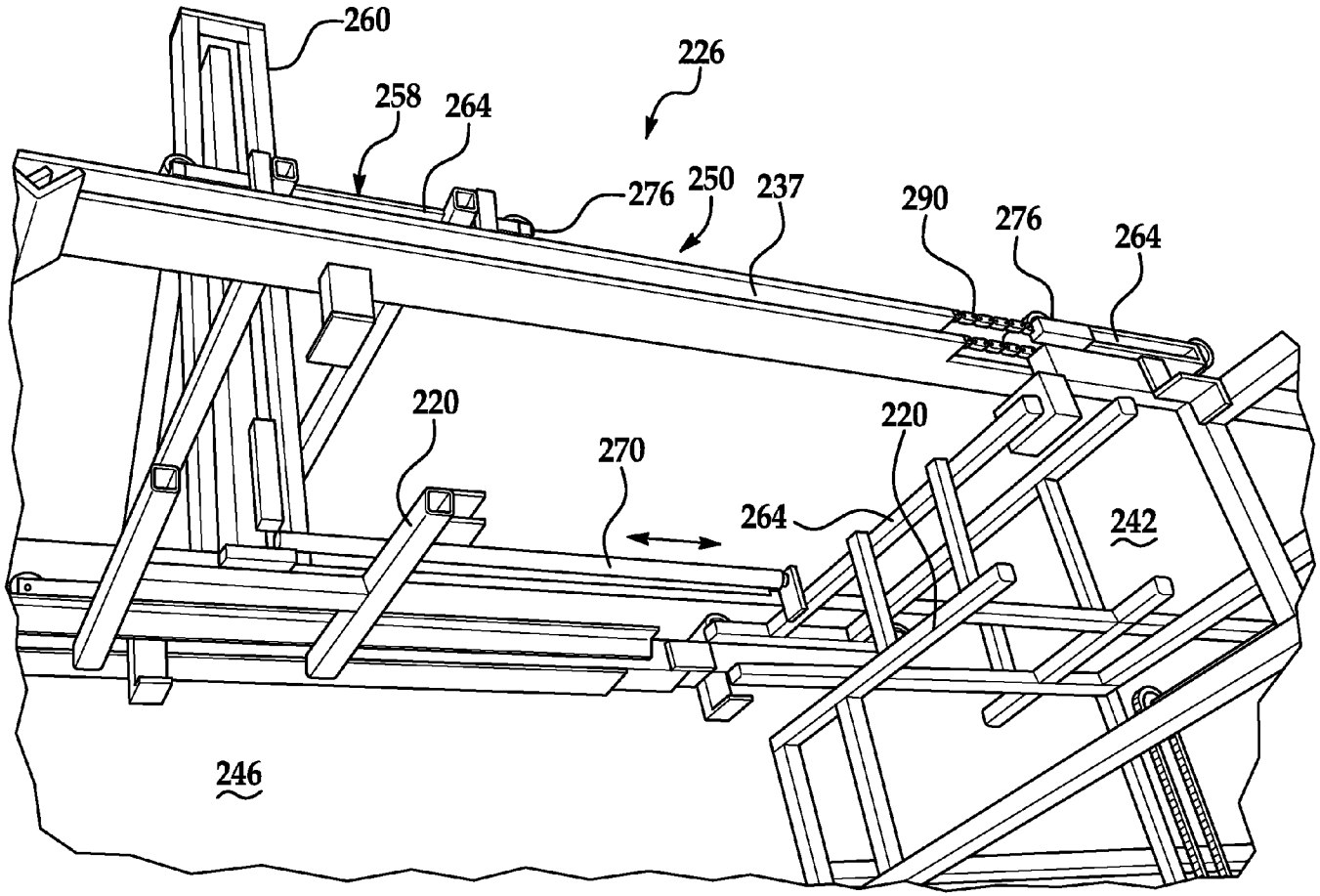
FIG. 14 is an enlarged partial perspective view of the device shown in FIG. 13.

Referring to FIGS. 12-14 an example of an alternate container manipulator with a lid transfer system 226 is illustrated. The alternate device further includes a second tower frame 230 and a tower bridge frame 236 spanning between and connected to the first tower frame 16. In the example, the container manipulator device 10 remains largely the same as previously described, except that as shown in FIG. 12, an optional modified conveyor 26' can extend to the second tower frame 230 from the first tower frame 16 (the conveyor 26 is shown in an unmodified configuration in FIG. 13). Tower bridge frame 236 is a scaffolding-type structure with elongate rails 237 and cross-members for a strong, rigid structure.

In the example, the first tower frame 16 and lid removal device 210 serve as a first lid station 238, an area of the tower bridge serves as a second lid station 240 and the second frame tower 230 defining a third lid station 246 as generally illustrated. In the example shown in FIGS. 13 and 14 the second frame tower 230 has only a pair of vertical end posts, versus the four vertical posts or pillars as described above for first tower frame 16. Other structures and configurations for second frame tower 230 known by those skilled in the art may be used.

As best seen in FIGS. 13 and 14, the exemplary lid transfer device 226 includes a tandem trolley 250 having a first carriage 254 and a second carriage 258. Each carriage includes a rigid frame 264 which spans the width of the bridge 236 and second tower 230 and is supported by wheels 276 which are supported by and travel on bridge rails 237. The first and the second carriage are connected together by a connecting rod 270 and move together as described below. Each carriage 254 and 236 include a lid removal device 210 including supports 220 and, for example, pneumatic suction cups which are selectively activated to grip a lid 206 and deactivated to release a lid 206 in a manner further described below. In the example, second carriage 258 further includes a lift which is operable to engage and lower a lid 206 along a fourth path of travel 278 to reinstall a previously removed lid 206 to a seed box 236 or other container positioned below the third lid station 246 as generally shown in FIG. 12.

In a preferred example, the two lid removal devices 210, one for first carriage 254 and one for second carriage 258 are positioned along a third path of travel 254 substantially longitudinally along bridge 236 between the first 16 and the second 230 frame towers. The lid removal devices 210 connected to trolley 250 are spaced apart along the third path of travel a distance equal to the distance between the first 238 and second 240 lid stations which is substantially equivalent to the distance between the second 240 and third 246 lid stations.

In the exemplary lid transfer device 226, a drive 280 is used to selectively move the trolley 250 to position a lid removal device 210 at the first 238 and second 240 lid stations or the second 240 and third 246 lid stations. The drive 280 includes a drive shaft 286 connected to a motor 294 attached to the second frame tower 230. At least one belt 290, shown in FIGS. 13 and 14 as a chain (two shown), is engaged with the drive shaft and connected on each end to the trolley 250 wherein on rotation of the motor and drive shaft, the trolley 250 moves between the lid stations as generally described or in a manner known by those skilled in the art. Other ways of connecting to and driving the trolley or supporting and moving the lids between stations known by those skilled in the art may be used.

In an example of operation of the lid transfer device 226, a first seed box 36 lid 206 is removed from the seed box 36 in the device 10 first tower frame 216 as generally described. Following reorientation of the seed box 36 as desired in device 10, while that seed box 36 is transferred to a position below the bridge 236 for inspection or other processes, the lid 206 is moved by the lid transfer device 226 along a third path of travel 252 to the second lid station 240. In this position, the second carriage 258 and connected lid removal device 210 is positioned at the third lid station 246. When a new seed box is positioned in device 10 for reorientation, the suction cups 216 of the first carriage 254 are released and the lid is lowered by gravity into a holding fixture (not shown) to await further processing. In a preferred example, the lid 206 is released onto a fixture (not shown).

The trolley 250 is then moved by drive 280, through commands or signals from the controller 30, back to the first lid station 238 to receive and engage another lid 206 in the manner described. In this position, second carriage 258 and lift 260 are positioned over the lid positioned in the fixture at the second lid station 240. Lift 240 lowers to engage the fixture lid and raise it free from the fixture. The trolley 250 is then moved to position the two engaged lids to the second 240 and third 246 lid stations wherein the lid at the second lift station 240 is released in the manner described above and the lift lowers lid 230 onto an awaiting seed box 36 positioned under lid station 246 in the manner described above. The lid removal and transfer of lids 206 repeats in a similar manner. Other processes for removing and transferring lids 206 may be used to suit the particular container or lids that are used with the containers as known by those skilled in the art.

Figure 15:
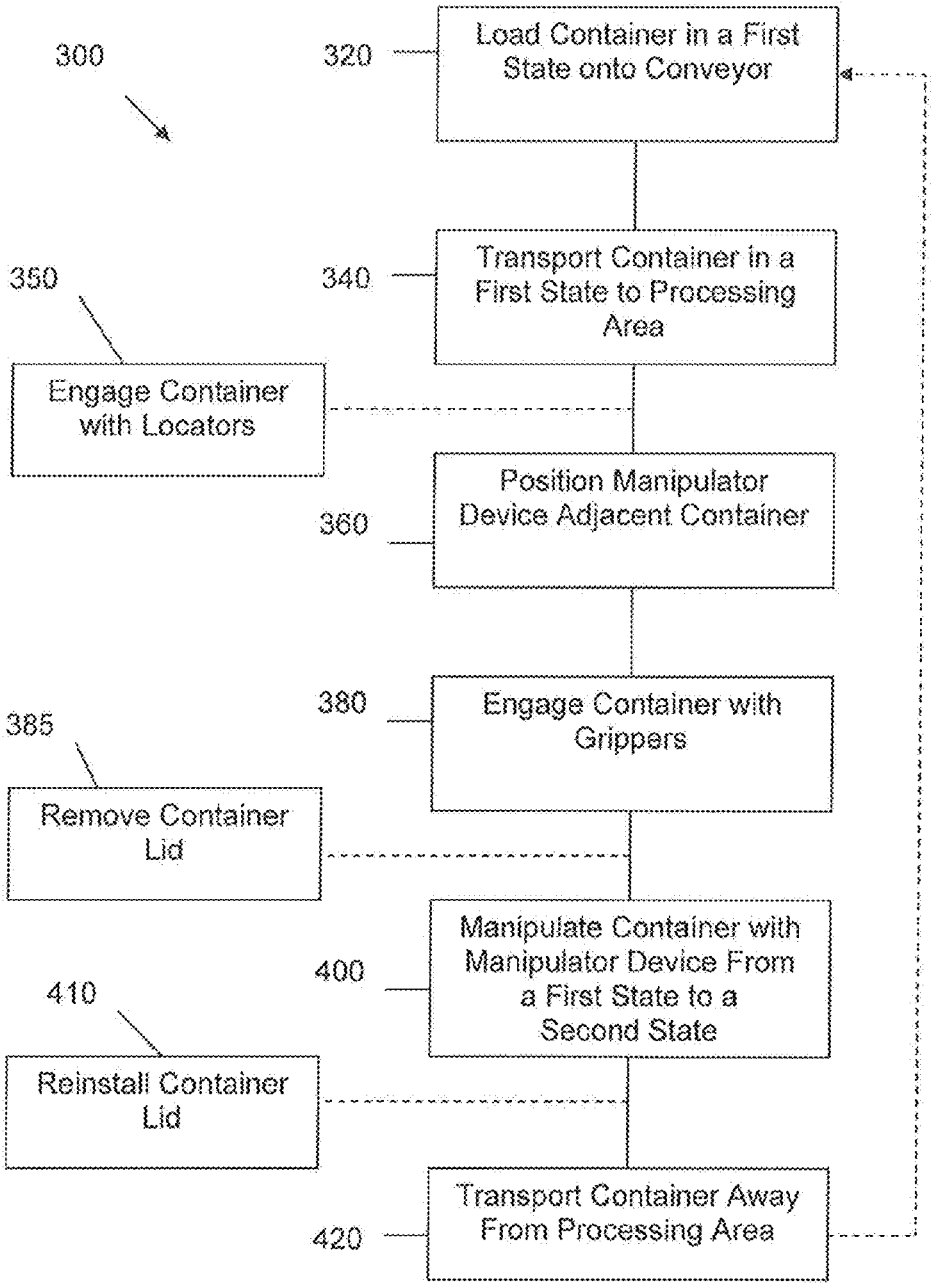
FIG. 15 is a schematic flow chart of an example of a process of manipulating a storage container using the exemplary manipulator device.

As generally shown in FIG. 15, a process 300 for manipulating a storage container, for example an agricultural seed box 36, from a first state to a second state is generally illustrated. In the example, a manipulator device is provided and positioned in a processing area where seed containers are either or both assembled or disassembled into a nested, lower height storage position.

In the exemplary process, in step 320 individual seed boxes in a first state or condition (assembled, full height) are positioned onto conveyor 26 as best seen in FIG. 2. This may be accomplished, for example, by a forklift or other device depending on the container, the rate or volume of processing and other factors known by those skilled in the art.

Although a simple conveyor is shown in the illustrations, it is understood that other conveyor and transfer devices, lifts, rotators and other equipment known by those skilled in the art may be used on both sides of the tower frame 16 and processing area to effectively and efficiently deliver and exit seed boxes 36 from the device 10 to suit the particular application and environment.

At this stage, lift frame 80 and grippers 112 and 116 are cycled or positioned to an elevated height, and the grippers positioned outward relative to frame 16 providing clearance for the box 36 to enter the processing area without contact with the lifting frame 80 and grippers 112 and 116.

On satisfying safety checks that the lift frame is in the upward and outward position, step 340 includes activating the conveyor drive 70 which rotate the rollers 68 to move the box into the processing area inside and below the lift frame 80.

In an optional but preferred step 350, locators 180 are activated to engage the base 40 of box 36 to accurately and precisely position the box relative to frame 16 and lift frame 80.

In an optional step not shown, a vision or other verification device may be used to determine what specific type of container or the state that a particular container is in has been loaded onto conveyor 26 or positioned in the process area. On such determination or verification, the controller 30 may access, load and execute a preloaded program specific to that detected and identified type of container.

Once the container 36 is positioned in the processing area in frame 16, step 360 includes actuating the lift device 20 to lower the lift frame 80 and attached grippers 112 and 116 to a predetermined position adjacent the box 36, preferably positioning the grippers adjacent opposing sides of box upper ring 46.

In step 380, gripper pivot arms 156 are rotated about pivot points 160 by movement of the respective cylinders 166 to synchronously place the grippers 112 and 116 and pads 122 into contact with opposing sides of the box ring 46 and apply a predetermined pressure by compression of springs 130.

In step 400, the container is manipulated from a first state to a second state according to the predetermined and desired manipulation of the container. In a preferred example of disassembling a seed box 36 that was in a first or assembled state having a base 40 and upper ring 46 to a second or nested or storage state, the lift frame is raised thereby disengaging the upper ring 46 from the base 40. Once the box upper ring 46 is raised to a sufficient height above and clear of base 40, the drive gripper, here first gripper 112, is forcibly rotated by drive 136 to rotate about 180 degrees to invert box ring 46 to a position where the respective cavities of the base 40 and ring 46 face one another. The second, non-driven gripper 116 maintains engagement with the ring 46 and rotates with the ring as directed by the driven gripper 112.

The lift frame 80 is then lowered to achieve a second state wherein the base 40 is nested inside the inverted upper ring 46 reducing the height of the box 36 for storage and/or transportation.

In an alternate process where the seed box 36 is to be assembled. In other words, the first state of the container is a nested box 36 (as described above), and the inverted ring 46 is to be manipulated to assemble the seed box to a full height second state to be loaded with seed or other media. In the example, the lift and manipulator devices 20 and 22 would grip, lift and rotate the upper ring an opposite 180 degrees and then lower to set the upright ring 46 atop the base as substantially described for disassembling box 36.

On satisfaction of safety checks, for example lift frame 80 and grippers 112 and 116 are positioned in a high height and outward positions with respect to frame 16, in step 420, the assembled or disassembled box 36 is transported from the processing area in frame 16 by conveyor 26 and another box 36 is loaded onto conveyor 26 for manipulation and processing.

In an option method step 410 a lid 206 of the box 36 may be manipulated, removed and/or installed as part of the device 10 and process 300 as previously described above. In the example, four actuators are connected to the lift frame 80 on opposing sides of the lift frame 80. The actuators are each connected to a pneumatic cylinder which operates to selectively engage a portion of the lid to dislodge the lid from the upper ring 46 which is then supported on a top surface of ring 46 by gravity. In one example, the ring and loose lid is raised by the lift mechanism 20 as described above and placed in contact with a plurality of pneumatic suction cup devices (not shown) connected to the frame 16 cross members 54 which engage the lid preventing movement of the lid with respect to the stationary suction cups. The lift device 20 is then lowered and manipulator device 22 then continues through the predetermined cycle, for example, inverting the box ring 46 to a nested or storage position. Once nested, the lid is place atop the nested box 36 before being moved from the frame 16. In the reverse process where the box 36 is manipulated to assemble the ring 46 atop the base 40, the process is essentially reversed and completed with the lid being placed atop the ring 46.

Additional process steps, and the order in which such steps occur, known by those skilled in the art may be used. For example, when the lid transfer system 226 is used, the lid 206 may not be reinstalled on the seed box 36 until after the seed box is transferred from the first tower base and processing area as generally shown in FIGS. 12-14 and described above.

It is further understood that other containers or devices, other than seed box 36, are usable with the device 10 and process 300. Through changes in the form and orientation of the grippers 112 and 116 as well as the movement of lift frame 80 and conveyor 26, the device 10 and process 300 are easily adapted and used for a variety of operations on large containers and other objects, both inside and outside of the agricultural field as known by those skilled in the art.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A manipulator device for use with an agricultural seed box having a base and a removable upper ring, the device comprising:

a rigid first tower frame defining a process area;

a conveyor defining a conveyor path of travel, the conveyor operative to support an agricultural seed box by its base and move the agricultural seed box along the conveyor path of travel into and out of the process area;

a manipulator device located at the process area, the manipulator device including a rigid manipulator carriage and a first gripper and a second gripper moveably connected to the manipulator carriage, the manipulator device operable to selectively support an agricultural seed box's upper ring for lifting from its base and inversion relative to the manipulator carriage by engaging the first and second grippers with respective opposing upright walls of the upper ring, the first and second grippers each including a gripper frame and a plurality of pads extending from the gripper frame, with the plurality of pads being arranged in a generally common upright plane to engage an upright wall of the upper ring at multiple outboard locations; and a lifting device connected to the first tower frame and engageable with the manipulator carriage to define a manipulator carriage path of travel substantially perpendicular to the conveyor path of travel, the lifting device operative to, with the manipulator device supporting the upper ring, selectively move the manipulator carriage along the manipulator carriage path of travel from a first position to an elevated second position sufficient to invert the upper ring.

2. The device of claim 1 wherein the gripper frames of the first and second grippers are each rotatable with respect to the manipulator carriage and at least one of the first and second grippers are connected to a drive to forcibly rotate the gripper frame relative to the manipulator carriage to selectively invert the upper ring relative to the manipulator carriage.

3. The device of claim 2 wherein the manipulator device further comprises:

a pivot arm having a first and a second end, the pivot arm hingedly connected to the manipulator carriage at its first end and supporting one of the first or the second gripper frame about its second end; and an actuator connected between the manipulator carriage and the second end of the pivot arm, the actuator operable to selectively move and position the supported gripper in the process area to selectively engage an upright wall of the upper ring.

4. The device of claim 3 wherein the manipulator device comprises a pair of pivot arms and actuators, one pivot arm and actuator for each of the first and the second grippers, the actuators synchronously operative to selectively move the respective grippers toward or away from one another in the process area.

5. The device of claim 3 wherein the gripper device further comprises a biasing member positioned between the pivot arm and the gripper frame operable to provide a range of compression force on engagement of the gripper with an upright wall of the upper ring.

6. The device of claim 1 wherein the lifting device further comprises:

a drive motor connected to the first tower frame;

a drive shaft connected to the motor and having a pair of opposed sprockets adjacent the ends of the drive shaft, the drive shaft rotatable about an axis of rotation;

a pair of chains engageable with the respective sprockets each having a first end and a second end, the first and second ends connected to the manipulator carriage wherein on movement of the drive motor, the manipulator device is moved along the manipulator carriage path of travel relative to the first tower frame.

7. The device of claim 1 further comprising a first and a second locator connected to the first tower frame and positioned on opposing sides of the conveyor path of travel, each locator having a pad selectively engageable with the base of an agricultural seed box to position the agricultural seed box at a predetermined location in the process area.

8. The device of claim 7 wherein each locator further comprises:

an arm pivotally connected to the first tower frame, the pad connected to a distal end of the arm; and an actuator connected to the first tower frame and the arm wherein the actuator selectively moves the pad from a first position toward the first tower frame to a second position in engagement with the base of an agricultural seed box.

9. The device of claim 1 wherein the agricultural seed box further includes a removable lid, the device further comprising:

a lid removal device connected to the first tower frame, the lid removal device comprising a lid engagement member positioned in the process area, the lid engagement member operative to selectively engage and hold the lid relative a remainder of the agricultural seed box until selectively disengaged to place the lid in contact with the agricultural seed box.

10. The device of claim 9 further comprising a lid transport device wherein the process area defines a first lid station, the lid transport device comprising:

a second rigid tower frame positioned distant from the first tower frame, wherein the conveyor extends from the first tower frame to the second tower frame;

a tower bridge frame connecting the first tower frame to the second tower frame, the bridge frame defining a second lid station and the second tower frame defining a third lid station; and a lid conveyor positioned between the first tower frame and the second tower frame, the lid conveyor defining a lid path of travel elevated over the conveyor path of travel, for selective movement of the lid engagement member between the first, the second and the third lid stations.

11. The device of claim 10 wherein the lid engagement member comprises a first lid engagement member and a second lid engagement member, each lid engagement member connected to the lid conveyor and spaced apart along the lid path of travel a distance between the first and the second lid stations, wherein the lid transport device is operable to selectively shuttle removed lids between the first, the second and the third lid stations.

12. The device of claim 11 wherein the lid transport device further comprises a lid actuator positioned at the third lid station and connected to the second tower frame, the lid actuator operable to place the previously removed and transported lid back on the agricultural seed box that has been transported by the conveyor from the first tower frame to the second tower frame.

13. A method for reorienting an agricultural seed box having a base and a removable upper ring from a first orientation state to a second orientation state using a manipulation device having a first tower frame defining a processing area, a lift device connected to the tower frame, a manipulating device connected to lifting device having a first gripper and a second gripper, and a conveyor in communication with the processing area, the method for reorienting an agricultural seed box comprising:

loading an agricultural seed box with its upper ring positioned on its base in a first orientation state onto a conveyor defining a first path of travel;

transporting the agricultural seed box with the conveyor along the first path of travel into the processing area;

lowering the manipulation device along a second path of travel proximate the upper ring;

engaging opposing, substantially flat upright walls of the upper ring with respective of the first and the second manipulation device grippers, with each upright wall being engaged by a plurality of pads at multiple outboard locations;

with the opposing upright walls of the upper ring engaged, elevating the manipulation device to raise the upper ring from the base;

with the upper ring raised from the base, inverting the upper ring relative to the base through moving the first and the second grippers relative to the first tower frame;

lowering the manipulation device to lower the upper ring back onto the base, forming a second orientation state; and transporting the agricultural seed box in the second orientation state with the conveyor along the first path of travel out of the processing area.

14. The method of claim 13 wherein the step of engaging the upright walls of the upper ring with the first and the second grippers further comprises the step of pivoting the grippers on respective pivot arms connected to the first tower frame to accommodate different size containers.

15. The method of claim 14 wherein the step of engaging the upright walls of the upper ring with the first and the second grippers further comprises the step of compressing a biasing member in each gripper to apply a linear range of pressure to accommodate different sizes and locational positions of the upper ring in the processing area.

16. The method of claim 13 further comprising the step of engaging and removing a lid from the agricultural seed box in the processing area at a first lid station.

17. The method of claim 16 wherein the step of removing the lid from the agricultural seed box further comprises the steps of:

transporting the removed lid along a third path of travel to a second lid station; and replacing the removed lid back onto the agricultural seed box through movement along a fourth path of travel.

18. A manipulator device for use with agricultural seed box having a first orientation state and a second orientation state, the device comprising:

means for loading an agricultural seed box with its upper ring positioned on its base in a first orientation state onto a conveyor defining a first path of travel;

means for transporting the agricultural seed box along the first path of travel into the processing area;

means for lowering the manipulation device along a second path of travel proximate the upper ring;

means for engaging opposing, substantially flat upright walls of the upper ring with respective first and second manipulation device grippers, with each upright wall being engaged by a plurality of pads at multiple outboard locations;

means for elevating the manipulation device to raise the upper ring from the base while the opposing upright walls of the upper ring are engaged;

means for inverting the upper ring relative to the base through moving the first and the second grippers relative to the first tower frame;

means for lowering the manipulation device to lower the upper ring back onto the base, forming a second orientation state; and means for transporting the agricultural seed box in the second orientation state with the conveyor along the first path of travel out of the processing area.

* * * * *